US006686325B2

(12) United States Patent
Hoyt et al.

(10) Patent No.: US 6,686,325 B2
(45) Date of Patent: Feb. 3, 2004

(54) ALKALINE SENSITIVE METAL CLEANING COMPOSITION, METHOD FOR CLEANING AN ALKALINE SENSITIVE METAL SURFACE, AND WASHING FACILITY

(75) Inventors: Jerry D. Hoyt, Hastings, MN (US); Michael E. Besse, Golden Valley, MN (US); Terry J. Klos, Victoria, MN (US); Mark Levitt, St. Paul, MN (US); Richard O. Ruhr, Buffalo, MN (US)

(73) Assignee: Ecolab Inc., St. Paul, MN (US)

( * ) Notice: Subject to any disclaimer, the term of this patent is extended or adjusted under 35 U.S.C. 154(b) by 69 days.

(21) Appl. No.: 10/099,535

(22) Filed: Mar. 15, 2002

(65) Prior Publication Data

US 2003/0176305 A1 Sep. 18, 2003

(51) Int. Cl.[7] ..... C11D 14/02; C11D 3/22; C23G 14/02; C23G 3/22; B08B 3/14

(52) U.S. Cl. ..... 510/255; 510/189; 510/197; 510/245; 510/254

(58) Field of Search ..... 510/189, 197, 510/245, 254, 255; 134/2, 40, 42

(56) References Cited

U.S. PATENT DOCUMENTS

| | | | | |
|---|---|---|---|---|
| 3,123,640 A | | 3/1964 | Longley | |
| 3,141,905 A | | 7/1964 | Longley | |
| 3,419,502 A | | 12/1968 | Newman | |
| 3,653,095 A | | 4/1972 | Dupre et al. | |
| 4,787,999 A | | 11/1988 | Dingess | |
| 5,710,120 A | | 1/1998 | Kanluen et al. | |
| 5,814,588 A | * | 9/1998 | Cala et al. | 510/175 |
| 5,902,415 A | * | 5/1999 | Dunn et al. | 134/42 |
| 6,124,253 A | * | 9/2000 | Vinci et al. | 510/254 |
| 6,251,847 B1 | * | 6/2001 | Pierce et al. | 510/365 |
| 6,569,264 B1 | * | 5/2003 | Fukumura et al. | 148/259 |
| 2003/0109394 A1 | * | 6/2003 | Ruhr et al. | 510/202 |

OTHER PUBLICATIONS

"Bayhibit AM. Properties, Effects, Applications of the Mobay Phosphonate", *Mobay Corporation,* pp. 5–40 (1990).

"Data Sheet No. 606. Pfizer Aminocarboxylic Chelating Agents", *CHas. Pfizer & Co., Inc.,* 23 pages (Date Unknow).

"Data Sheet 681. Technical Information Pfizer Organic Cehlating Agents", *Pfizer Inc.,* pp. 1–33 (1984).

"Dequest® Product Line", 20 pages (Date Unknown).

"Metal Ion Control for Hard Surface Cleaners. VERSENE chelating agents control reactive metal ions and improve cleaning performance", *The Dow Chemical Company,* 7 pages (Oct. 1995).

"Sodium Gluconate Handbook," *PMP Fermentation Products, Inc.,* pp. 1–22 (Apr. 1991).

"The more you know about Versene chelating agents, the less trouble you'll have with unwanted metal ions", pp. 3–29 (Date Unknown).

* cited by examiner

*Primary Examiner*—Yogendra N. Gupta
*Assistant Examiner*—John M Petruncio
(74) *Attorney, Agent, or Firm*—Merchant & Gould P.C.

(57) ABSTRACT

An alkaline sensitive metal cleaning composition is provided. The alkaline sensitive metal cleaning composition contains an alkaline concentrate and a corrosion inhibitor concentrate. The alkaline concentrate includes a source of alkalinity in an amount sufficient to provide a use solution having a pH of at least 10.0, and a first chelant component that exhibits soil removal properties when used at a pH of at least 10.0. The corrosion inhibitor concentrate includes a corrosion inhibitor component for reducing corrosion of alkaline sensitive metals when used in a use solution having a pH of at least 10.0, a second chelant component for stabilizing the corrosion inhibitor in the corrosion inhibitor concentrate when the corrosion inhibitor concentrate is provided at a pH that is less than 8.0, and a surfactant component for providing cleaning properties when used at a pH of at least 10.0. A threshold inhibitor/crystal modifier can be provided in at least one of the alkaline concentrate and the corrosion inhibitor concentrate to stabilize the corrosion inhibitor in a use solution at a pH of at least 10.0. A method for cleaning an alkaline sensitive metal surface and a washing facility are provided.

41 Claims, 1 Drawing Sheet

ALKALINE SENSITIVE METAL CLEANING COMPOSITION, METHOD FOR CLEANING AN ALKALINE SENSITIVE METAL SURFACE, AND WASHING FACILITY

FIELD OF THE INVENTION

The invention relates to an alkaline sensitive metal cleaning composition, a method for cleaning an alkaline sensitive metal surface, and a washing facility.

BACKGROUND OF THE INVENTION

Many articles having a surface that requires cleaning contain an alkaline sensitive metal, such as, aluminum or aluminum containing alloys. Such articles can be found in industrial plants, maintenance and repair services, manufacturing facilities, kitchens, and restaurants. Exemplary equipment having a surface containing an alkaline sensitive metals include sinks, cookware, utensils, machine parts, vehicles, tanker trucks, vehicle wheels, work surfaces, tanks, immersion vessels, spray washers, and ultrasonic baths.

Aqueous alkali cleaners are known as effective cleaning agents. However, many alkali cleaners have disadvantages when used on alkaline sensitive metals, such as, aluminum. A problem with using aqueous alkali systems to clean aluminum surfaces is the potential to corrode and/or discolor. While aqueous alkaline cleaning solutions having a high pH are often more corrosive than aqueous alkaline solutions having a relatively low pH, corrosion and discoloration can still be problematic with the more mild solutions.

Various corrosion inhibitors have been used to prevent corrosion of surfaces that come into contact with aqueous alkaline solutions. Exemplary corrosion inhibitors include silicates, such as, sodium silicate. Sodium silicate has a tendency to begin precipitating from aqueous solution at a pH below 11, thus reducing its effectiveness to prevent corrosion of the contacted surfaces when used in aqueous cleaning solutions having a lower pH. Additionally, when silicates are allowed to dry on the surface to be cleaned, films or spots are often formed, which are visible and which are themselves very difficult to remove. The presence of these silicon containing deposits can affect the texture of the cleaned surface, the appearance of the surface, and on cooking or storage surfaces, can affect the taste of the materials that come into contact with the cleaned surfaces.

SUMMARY OF THE INVENTION

An alkaline sensitive metal cleaning composition is provided according to the invention. The alkaline sensitive metal cleaning composition includes an alkaline concentrate and a corrosion inhibitor concentrate that can be diluted and combined to provide a use solution that can be used to clean alkaline sensitive metals. The alkaline concentrate includes a source of alkalinity in an amount sufficient to provide a use solution having a pH of at least 10.0, and a first chelant component that exhibits soil removal properties when used at a pH of at least 10.0. The corrosion inhibitor concentrate includes a corrosion inhibitor component for reducing corrosion of alkaline sensitive metals when used in a use solution having a pH of at least 10.0, a second chelant component for stabilizing the corrosion inhibitor in the corrosion inhibitor concentrate when the corrosion inhibitor concentrate is provided at a pH that is less than 8.0, and a surfactant component for providing cleaning properties when used at a pH of at least 10.0. A threshold inhibitor/crystal modifier can be provided in at least one of the alkaline concentrate and the corrosion inhibitor concentrate to stabilize the corrosion inhibitor in a use solution at a pH of at least 10.0. A hydrotrope component can be included in the corrosion inhibitor concentrate to help stabilize the surfactant component. It should be understood that the hydrotrope component can be omitted if it is not needed to stabilize the surfactant component.

A method for cleaning an alkaline sensitive metal surface is provided according to the invention. The method includes steps of forming the use solution from the alkaline concentrate and the corrosion inhibitor concentrate, and applying the use solution to the alkaline sensitive metal for cleaning the metal.

A washing facility is provided according to the invention. The washing facility can be characterized as a vehicle washing facility when it is constructed to wash vehicles. The washing facility includes a first component tank, a second component tank, a mixing vessel, a water feed, and a use solution line. The first component tank is provided for containing the alkaline concentrate. The second component tank is provided for containing the corrosion inhibitor concentrate. The mixing vessel is provided for mixing water, the alkaline concentrate, and the corrosion inhibitor concentrate to provide a use solution. The water feed is provided for conveying water to the mixing vessel for diluting the alkaline concentrate and the corrosion inhibitor concentrate. The use solution line is provided for conveying the use solution from the mixing vessel to a use solution applicator.

DETAILED DESCRIPTION OF THE INVENTION

Figure 1:
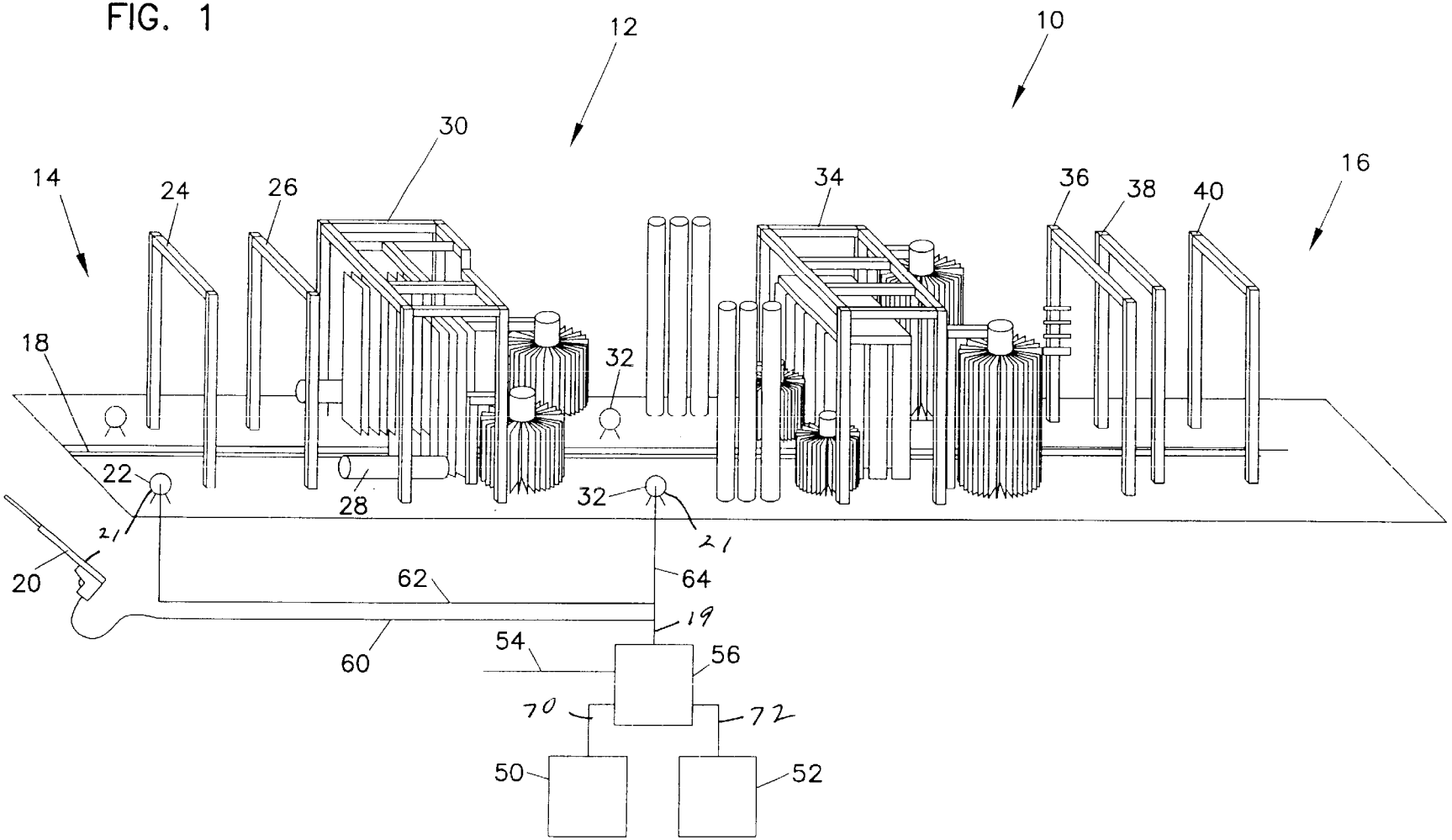
FIG. 1 is a diagrammatic view of a vehicle washing facility that utilizes a cleaning composition for alkaline sensitive metals according to the principles of the present invention.

Cleaning compositions for alkaline sensitive metals can be provided by the invention. The phrase "alkaline sensitive metal" identifies those metals that exhibit corrosion and/or discoloration when exposed to an aqueous alkaline solution. An aqueous alkaline solution is an aqueous solution having a pH that is greater than 8. Exemplary alkaline sensitive metals include soft metals such as aluminum, nickel, tin, zinc, copper, brass, bronze, and mixtures thereof. Aluminum and aluminum alloys are common alkaline sensitive metals that can be cleaned by the cleaning compositions of the invention.

The cleaning compositions according to the invention can take the form of multiple concentrates that can be diluted and combined to provide a use solution, multiple solutions that can be combined to provide a use solution, and as a use solution that can be used to clean alkaline sensitive metals. The multiple solutions can be provided as a first solution and a second solution. The solutions can be in the form of concentrates that can be diluted with water and combined to provide a use solution that can be applied to alkaline sensitive metals. In addition, the solutions can be provided as relatively dilute solutions that can be combined, without the addition of water, to provide a use solution that can be applied to alkaline sensitive metals. It is advantageous to provide the solutions as concentrates and then to dilute the concentrates at the situs of use in order to decrease transportation costs associated with transporting large amounts of water. The multiple solutions can remain separate until it is desired to mix them. If the solutions are provided as concentrates, it is advantageous to dilute each concentrate and then mix the diluted concentrates to provide a use solution. Either one or more of the concentrates can be diluted and then the remaining concentrate(s) can either be diluted or added directly to the diluted concentrate to provide the use solution.

Alkaline sensitive metals in need of cleaning are found in several locations. Exemplary locations include trucks, vehicle wheels, ware, and facilities. One exemplary application of the alkaline sensitive metal cleaning composition for cleaning alkaline sensitive metals can be found in cleaning vehicle wheels in a vehicle washing facility. Referring to FIG. 1, a vehicle washing facility is shown at reference numeral 10. The vehicle washing facility 10 is a tunnel washer 12. A vehicle enters the tunnel washer 12 at the entry 14 and leaves at the exit 16. The vehicle is pulled through the tunnel washer along the track 18. The tunnel washer 12 can include numerous washing stations or stages. Many of the stations or stages can be found in commercial tunnel washers. Many commercial tunnel washers offer a selection of different vehicle washing programs. A patron generally selects and pays for a desired vehicle washing program. Depending on the program selected, various components of the vehicle washing facility will be activated. For example, a patron may select a program that provides for washing the vehicle wheels according to the invention.

Upon entry of the vehicle into the tunnel washer 12, the wheels can be sprayed manually with an alkaline sensitive metal cleaning composition at the spray gun 20. In addition, the wheels can be sprayed with an alkaline sensitive metal cleaning composition by an automated wheel sprayer 22. A first pre-soak arch 24 and a second pre-soak arch 26 can be provided to spray the vehicle with a detergent to loosen soil from the vehicle surface. A tire and wheel washer 28 can be provided for applying friction to the tires and the wheels to remove soil. A foamer 30 can be provided for applying friction to the vehicle surface to help remove soil. A wheel sprayer 32 can be provided downstream of the foamer 30 for applying an alkaline sensitive metal cleaning composition to the wheels. A polisher 34 can be provided for rinsing the vehicle. A drying arch 36, a sealant arch 38, and a protectant arch 40 can be provided for applying a drying agent, a sealant, and a protectant to the vehicle.

The cleaning composition can be prepared by diluting and mixing the components of a first component tank 50 and a second component tank 52. A first concentrate or an alkaline concentrate can be provided in the first component tank 50, and a second concentrate or a corrosion inhibitor concentrate can be provided in the second component tank 52. A water inlet feed 54 can be provided for diluting the first concentrate and the second concentrate in a mixing vessel 56. The combination of the water, the first concentrate, and the second concentrate results in a use solution that is fed via the use solution line 19 to a use solution applicator 21. Exemplary use solution applicators 21 include the spray gun 20 via the spray gun line 60, to the wheel washer 22 via the wheel washer line 62, and to the wheel washer 32 via the wheel washer line 64. The components of the first component tank 50 and the second component tank 52 can be pumped into the mixing vessel 56 or drawn into the mixing vessel 56 as a result of an aspirator. An additional pump can be provided for pressurizing the cleaning composition use solution leaving the mixing vessel 56. Alternatively, the pressure created by the water inlet feed 54, the first component tank feed line 70 and/or the second component feed line 72 may be sufficient to deliver the cleaning composition.

The concentration of the use solution can be varied depending upon its application. For example, the concentration of the use solution applied through the spray gun 20 can be relatively less concentrated than the use solution applied through the wheel washer 22 or the wheel washer 32. The reason for this is that it is expected that the use solution will have a longer contact time with the alkaline sensitive metal when applied via the spray gun 20 before it is washed off. In contrast, the use solution applied via the wheel washer 22 or the wheel washer 32 should be sufficiently concentrated to provide a desired level of cleaning before it becomes washed off or removed from the alkaline sensitive metal.

The cleaning composition can be made available as multiple concentrates that are diluted and combined at the situs of use to provide a use solution for application to alkaline sensitive metals. An advantage of providing concentrates that are later combined is that shipping and storage costs can be reduced because it can be less expensive to ship and store a concentrate rather than a use solution. Although the cleaning composition according to the invention can be provided as multiple concentrates, it should be understood that the cleaning composition can be provided as a use solution. In addition, the multiple concentrates can include two or more concentrates that are added together. In addition, the concentrates can be provided in the form of a liquid or solid. An advantage of forming the use solution from two concentrates is that it is only necessary to control the amounts of chemicals from two concentrates when forming the use solution. It is expected that by adding an additional concentrate, the complexity and expense of the system for forming the use solution will increase.

The cleaning composition can be characterized as including an alkaline concentrate and a corrosion inhibitor concentrate. The alkaline concentrate includes a source of alkalinity and a first chelant component. The source of alkalinity is provided so that the use solution has a pH of at least 10.0. The first chelant component exhibits soil removal properties when provided as part of the use solution at a pH of at least 10.0. The corrosion inhibitor concentrate includes a corrosion inhibitor component, a second chelant component, and a surfactant component. The corrosion inhibitor component is provided for reducing corrosion of alkaline sensitive metals by the use solution having a pH of at least 10.0. The second chelant component is provided for stabilizing the corrosion inhibitor in the corrosion inhibitor concentrate when the concentrate is provided at a pH that is less than 8.0. The pH of the corrosion inhibitor concentrate can be less than 8.0. The surfactant component provides cleaning properties when used as part of the use solution at a pH of at least 10.0. A threshold inhibitor/crystal modifier can be provided to stabilize the corrosion inhibitor in the use solution provided at a pH in the range of 10.0 to 14.0. Although the threshold inhibitor/crystal modifier helps stabilize the corrosion inhibitor in the use solution, the corrosion inhibitor remains available to provide corrosion inhibiting properties. The threshold inhibitor/crystal modifier can be provided in the alkaline concentrate and/or the corrosion inhibitor concentrate, or it can be provided in another concentrate for addition to the alkaline concentrate, the corrosion inhibitor concentrate, and/or the use solution. It should be understood that certain components of the alkaline concentrate and/or the corrosion inhibitor concentrate can be split out and placed in a separate concentrate or solution for subsequent addition to provide a use solution. In addition, it is expected that certain components may be placed in different concentrates. For example, the first chelant component may be placed in the corrosion inhibitor concentrate, and the surfactant component may be placed in the alkaline concentrate.

Source of Alkalinity

The source of alkalinity can be any source of alkalinity that is compatible with the other components of the cleaning composition and that will provide the use solution with the desired pH. Exemplary sources of alkalinity include alkali metal hydroxides, alkali metal salts, silicates, phosphates, amines, and mixtures thereof. Exemplary alkali metal hydroxides include sodium hydroxide, potassium hydroxide, and lithium hydroxide. The alkali metal hydroxide may be added to the composition in a variety of forms, including for example in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 45 wt. %, 50 wt. % and a 73 wt. % solution.

Exemplary alkali metal salts include sodium carbonate, trisodium phosphate, potassium carbonate, and mixtures thereof. Exemplary silicates include sodium metasilicates, sesquisilicates, orthosilicates, potassium silicates, and mixtures thereof. Exemplary phosphates include sodium pyrophosphate, potassium pyrophosphate, and mixtures thereof. Exemplary amines include alkanolamine. Exemplary alkanolamines include triethanolamine, monoethanolamine, diethanolamine, and mixtures thereof.

The source of alkalinity is provided in an amount sufficient to provide the use solution with a pH of at least 10.0. The use solution can be provided having a pH of between about 10.0 and about 14.0, and can be provided having a pH of between about 10.5 and about 13.5. In general, the amount of the source of alkalinity provided in the alkaline concentrate can be provided in an amount of at least about 0.05 wt. % based on the weight of the alkaline concentrate. The source of alkalinity can be provided in the alkaline concentrate in an amount of between about 0.05 wt. % and about 99 wt. %, and can be provided in the alkaline concentrate in an amount of between about 0.1 wt. % and about 95 wt. %.

First Chelant Component

The first chelant component includes a chelant that exhibits soil removal properties when used at a pH of at least about 10.0. The first chelant component is provided for tying up metals in the soil to assist in cleaning and detergency. The first chelant component can be provided as part of the alkaline concentrate. Exemplary chelants that exhibit soil removal properties at a pH of greater than 10.0 that can be used according to the invention as the first chelant component include sodium gluconate, pentasodium salt of diethylenetriamine pentaacetic acid (available under the name Versenex 80), sodium glucoheptonate, ethylene diamine tetraacetic acid (EDTA), salts of ethylene diamine tetraacetic acid, hydroxyethyl ethylene diamine triacetic acid (HEDTA), salts of hydroxyethyl ethylene diamine triacetic acid, nitrilotriacetic acid (NTA), salts of nitrilotriacetic acid, diethanolglycine sodium salt (DEG), ethanoldiglycine disodium salt (EDG), and mixtures thereof. Exemplary salts of ethylene diamine tetraacetic acid include disodium salts, tetrasodium salts, diammonium salts, and trisodium salts. An exemplary salt of hydroxyethyl ethylene diamine triacetic acid is the trisodium salt.

The first chelant component can be provided in the alkaline concentrate in an amount sufficient to provide the use solution with a desired level of detergency. An amount of the first chelant component in the alkaline concentrate can be at least about 0.005 wt. %. The first chelant component can be provided in the alkaline concentrate in an amount of between about 0.005 wt. % and about 55 wt. %, and can be provided in an amount of between about 0.01 wt. % and about 50 wt. %.

Corrosion Inhibitor Component

The corrosion inhibitor component can be any component that acts to reduce corrosion to alkaline sensitive metals when treated with a use solution having a pH of at least 10.0 compared with its absence. That is, corrosion inhibitors that can be used according to the invention include those corrosion inhibitors that exhibit a corrosion inhibiting or reducing affect on alkaline sensitive metals when used in a use solution having a pH that is at least 10.0. An exemplary corrosion inhibitor includes a source of calcium ion. Exemplary sources of calcium ion include calcium salts, calcium oxides, and mixtures thereof. Exemplary calcium salts include calcium acetate, calcium chloride, calcium gluconate, calcium phosphate, calcium borate, calcium carbonate, calcium citrate, calcium lactate, calcium sulfate, calcium tartrate, and mixtures thereof.

The corrosion inhibitor component can be provided in the corrosion inhibitor concentrate in an amount sufficient to provide a desired level of corrosion inhibition when used in the use solution. There should be sufficient amount of corrosion inhibitor to provide the desired corrosion inhibiting affect. It is expected that the upper limit on the corrosion inhibitor component will be controlled by solubility. The corrosion inhibitor component can be provided in the corrosion inhibitor concentrate in an amount of at least about 0.005 wt. %. The corrosion inhibitor component can be provided in the corrosion inhibitor concentrate in an amount of between about 0.005 wt. % and about 41.5 wt. %, and can be provided in an amount of between about 0.02 wt. % and about 27 wt. %.

Second Chelant Component

The second chelant component is provided for stabilizing the corrosion inhibitor component in the corrosion inhibitor concentrate when the corrosion inhibitor concentrate is provided at a pH that is less than 8.0. In general, it is expected that the second chelant component will function to stabilize the corrosion inhibitor at a lower pH but will lose or reduce its stabilizing properties once the pH is elevated. That is, when the alkaline concentrate and the corrosion inhibitor concentrate are diluted and combined to form a use solution having a pH of 10.0 to 14.0, it is expected that the second chelant component will be less effective. That is, the second chelant component is expected to lose its hold on the corrosion inhibitor once the pH is raised to at least 10.0. It should be appreciated that the second chelant component helps stabilize the corrosion inhibitor component in the corrosion inhibitor concentrate by reducing precipitation that may be caused by hardness in the water.

The second chelant component can include acids that function to stabilize the corrosion inhibitor component in the second concentrate. Exemplary second chelants include hydroxymonocarboxylic acid compounds and hydroxydicarboxylic acid compounds and mixtures thereof. Suitable hydroxymonocarboxylic acid compounds include, but are not limited to, citric acid; propionic acid; gluconic acid; glycolic acid; glucoheptanoic acid; succinic acid; lactic acid; methyllactic acid; 2-hydroxybutanoic acid; mandelic acid; atrolactic acid; phenyllactic acid; glyeric acid; 2,3,4-trihydroxybutanoic acid; alpha hydroxylauric acid; benzillic acid; isocitric acid; citramalic acid; agaricic acid; quinic acid; uronic acids, including glucuronic acid, glucuronolactonic acid, galaturonic acid, and galacturonolactonic acid;

hydroxypyruvic acid; ascorbic acid; and tropic acid. Preferred hydroxymonocarboxylic acid compounds include citric acid; propionic acid; gluconic acid; glycolic acid; glucoheptanoic acid; and succinic acid. Suitable hydroxydicarboxylic acid compounds include, but are not limited to, tartronic acid; malic acid; tartaric acid; arabiraric acid; ribaric acid; xylaric acid; lyxaric acid; glucaric acid; galactaric acid; mannaric acid; gularic acid; allaric acid; altraric acid; idaric acid; and talaric acid. Preferred hydroxydicarboxylic acid compounds include tartaric acid. An additional exemplary second chelant component includes ethylene diamine tetraacetic acid. It should be understood that the second chelant component can include mixtures of different chelants.

The second chelant component can be provided in the corrosion inhibitor concentrate in an amount to stabilize the corrosion inhibitor component. The second chelant component can be provided in the corrosion inhibitor concentrate in an amount of at least about 0.003 wt. %. An exemplary range of the second chelant component in the corrosion inhibitor concentrate can be between about 0.003 wt. % to about 23 wt. % based on the weight of the corrosion inhibitor concentrate, and can be provided in a range of between about 0.01 wt. % and about 15 wt. % based on the weight of the corrosion inhibitor concentrate.

Surfactant Component

The surfactant component provides for enhancing the cleaning properties of the use solution. The surfactant component can be used to reduce surface tension and wet the soil particulate to allow penetration of the use solution and separation of the soil. The surfactant component can include anionic surfactants, nonionic surfactants, cationic surfactants, amphoteric surfactants, zwitterionic surfactants, and mixtures thereof.

Exemplary nonionic surfactants that can be used in the surfactant component include alkoxylates, primary alcohol ethoxylates, amine oxides, salts of alkylamino acids such as sodium salts of alkylamino acids, and mixtures thereof.

Examples of nonionic surfactants include those nonionic surfactants having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonioincs such as alkyl polyglycosides; sorbilan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; dodecyl, octyl or nonylphenol ethoxylates, polyoxyethylene glycol ethers and the like; carboxylic acid esters such as methyl esters, glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other line nonionic compounds. Silicone containing nonionic surfactants such as the ABIL B8852 or Silwet 7602 can also be used.

Examples of amine oxide surfactants include: dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, lauryl dimethyl amine oxide, bis-(2-hydroxyethyl)dodecylamine oxide, bis-(2-hydroxyethyl)-3-dodecoxy-1-hydroxypropyl amine oxide, (2-hydroxypropyl)methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, non-ionic surfactants derived from the condensation of ethylene oxide with the product resulting from the reaction of propylene oxide and ethylene diamine are also useful. For example, there are compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000.

Other surfactants can be used in the compositions of this invention other than or in addition to the above-described surfactants. For example, silicone-containing surfactants can be used. An exemplary silicone-containing surfactant is silicone polybutane.

Suitable nonionic surfactants include the polyoxyethylene-polyoxypropylene condensates, which are sold by BASF under the trade name "Pluronic", polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the trade name "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide. Further exemplary non-ionic surfactants include alcohol alkoxylates, alkylphenol alkoxylates, and amine oxides such as alkyl dimethylamine oxide or bis(2-hydroxyethyl)alkylamine oxide.

Exemplary nonionic surfactants that can be used include alkoxylates. The alkoxylates can be alkoxylates having a mixture of different alkoxy repeating units. The alkoxylates can be alcohol ethoxylate/propoxylate polymers.

Exemplary cationic surfactants that can be used include ammonium cationic surfactants. Exemplary ammonium cationic surfactants include the ammonium cationic compound having the formula (II):

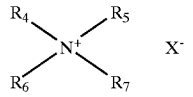

wherein $R_4$, $R_5$, $R_6$ and $R_7$ are each independently hydrogen, $C_1$–$C_{10}$ alkyl, $C_1$–$C_{10}$ alkoxy, or phenyl such that at least two of $R_4$, $R_5$, $R_6$ and $R_7$ are a $C_1$–$C_{10}$ alkyl, or at least one of $R_4$, $R_5$, $R_6$ and $R_7$ are a $C_1$–$C_{10}$ alkoxy; and X comprises an anion.

In one embodiment, $R_4$, $R_5$ and $R_6$ are each independently $C_1$–$C_6$ alkyl groups and $R_7$ is a polyoxyalkylene chain of general formula:

$$-(OCH_2CH_2)_m(OC\overset{CH_3}{\overset{|}{H}}CH_2)_nH \quad \text{or} \quad -(OCH_2CH_2)_n(OCH_2CH_2)_mH$$

wherein m is from 0 to 30, n is from 1 to 60, and X is an anion. In this embodiment, m plus n may be from 1 to 60 and n may be greater than m. Preferably, the ratio of n/in is at least 2, more preferably n/in is at least 4, even more preferably n/m is at least 5. Moreover, m may be 0. It is also preferred that in plus n is within the range of 5 to 60, still more preferably that m plus n is from about S to 50, and more preferably, m is) and n is 35–45.

In an embodiment, $R_4$ and $R_5$ are methyl. In this embodiment one of $R_6$ or $R_7$ can be phenyl.

The anion, $X^-$, may be any anion compatible with the composition. Suitable anions include anion of low molecular weight acids, such as chloride, bromide, iodide, sulfate, paratoluene, sulfonate, acetate, nitrate, nitrite, phosphate, and the like.

The ammonium cationic compounds may be commercially available, for example, as Witco Chemicals cationic quaternary ammonia compounds Emcol CC-9, Emcol CC-36, and Emcol CC-42. An exemplary compound is commercially provided as GLENSURF™ 42, which is believed to be inaccurately described as "Diethylammonium Chloride" in a PRODUCT DATA SHEET provided by Glenn Corporation, which sells the product. The CAS Number for the actual compound is 68132-96-7, its Chemical Abstract name of Poly[oxy(methy-1,2-ethanediyl)], alpha-[2-diethylmethylammonio)ethyl-omega-hydroxy chloride, and its chemical formula is listed as $(C_3H_60)_nC_7H_{18}N0)Cl$.

It is an option that the total number of carbon atoms among $R_4$, $R_5$, $R_6$ and $R_7$ can have a combined number of fewer than 12 carbon atoms (with the possible maximum being 12 carbon atoms). It is an additional option that the total number of carbon atoms in the $R_4$, $R_5$, and $R_6$ groups are between 3 and 12 carbon atoms or between 4 and 8 carbon atoms. The most common form of this class of surfactants has $R_4$, $R_5$, and $R_6$ as one methyl radical and two ethyl radicals. In describing compounds by structure and formula in the practice of the present invention, it is well understood that substitution of the compounds would be practiced within the background skill of one ordinarily skilled in the art.

Exemplary components are described in U.S. Pat. Nos. 3,123,640 and 3,141,905 as cation-active surface active chemical compounds. The cation-active compounds are quatenary ammonium compounds derived from lower inonoalkyl dialkanolamines. The cations-active compounds also include a) dialiphatic, dialkoxylated quatenary ammonium compounds, and b) inonoaliphatic, trialkoxylated quatenary ammonium compounds, as described by formulae in the patents, and are useful in the practice of the invention as the polyoxyalkylene ammonium cationic surfactants. Those patents are incorporated herein by reference for the disclosure of the structure of those classes of compounds.

Exemplary anionic surfactants that can be used include organic carboxylates, organic sulfonates, organic sulfates, organic phosphates and the like, particularly linear alkylaryl sulfonates, such as alkylarylcarboxylates, alkylarylsulfonates, alkylarylphosphates, and the like. These classes of anionic surfactants are known within the surfactant art as linear alkyl benzyl sulfonates (LABS), alpha olefin sulfonates (AOS), alkyl sulfates, and secondary alkane sulfonates.

Examples of suitable amphoteric surfactants include capryloamphopropionate, disodium lauryl B-iminodipropionate, and cocoamphocarboxypropionate, and disodium octylimino dipropionate.

The surfactant component can be provided in the corrosion inhibitor concentrate in an amount sufficient to provide a desired level of cleaning. The surfactant component can be provided in the corrosion inhibitor concentrate in an amount of at least about 0.01 wt. %. The surfactant component can be provided in the corrosion inhibitor concentrate in a range of between about 0.01 wt. % and about 75 wt. %, and can be provided in an amount of between about 0.05 wt. % and about 50 wt. %.

Threshold Inhibitor/Crystal Modifier Component

The threshold inhibitor/crystal modifier component is provided for reducing precipitation of the corrosion inhibitor in the use solution, but allows the corrosion inhibitor to be available to provide inhibiting properties. In general, it is expected that the threshold inhibitor/crystal modifier component will loosely hold the corrosion inhibitor to reduce precipitation of the corrosion inhibitor once it is subjected to a pH of at least 10.0 and the second chelant component no longer sufficiently functions to stabilize the corrosion inhibitor in the more alkaline environment. It is uncertain exactly how the threshold inhibitor/crystal modifier component works in the use solution. One theory is that the threshold inhibitor/crystal modifier component acts on the crystal of the corrosion inhibitor to reduce growth of the crystal thereby preventing growth of the crystal to an extent that will allow it to precipitate. In addition, it is expected that the threshold inhibitor/crystal modifier component can be used in a non-stoichiometric level which means that less of the threshold inhibitor/crystal modifier component can be used than would be expected based on a stoichiometric equivalence of the threshold inhibitor/crystal modifier component and the corrosion inhibitor.

Exemplary threshold inhibitor/crystal modifier components include phosphonocarboxylic acids, phosphonates, acid substituted polymers, and mixtures thereof. Exemplary phosphonocarboxylic acids include those available under the name Bayhibit® AM from Bayer, and include 2-phosphonobutane-1,2,4, tricarboxylic acid (PBTC). Exemplary phosphonates include amino tri(methylene phosphonic acid), 1-hydroxy ethylidene 1-1-diphosphonic acid, ethylene diamine tetra (methylene phosphonic acid), hexamethylene diamine tetra (methylene phosphonic acid), diethylene triamine penta (methylene phosphonic acid), and mixtures thereof. Exemplary phosphonates are available under the name Dequest® from Monsanto. Exemplary acid substituted polymers include polyacrylates, polymethacrylates, polyacrylic acid, polyitaconic acid, polymaleic acid, and mixtures thereof. It should be understood that the mixtures can include mixtures of different acid substituted polymers within the same general class. In addition, it should be understood that salts of acid substituted polymers can be used. An exemplary salt is sodium polyacrylate and is available under the name Acusol 929.

The threshold inhibitor/crystal modifier component can be provided in the alkaline concentrate and/or the corrosion inhibitor concentrate. The threshold inhibitor/crystal modifier component should be provided in an amount sufficient so that when it is in the use solution, it sufficiently protects the corrosion inhibitor from precipitation while allowing the corrosion inhibitor to function to reduce corrosion and/or discoloration of alkaline sensitive metals. The threshold inhibitor/crystal modifier component can be provided in either or both of the concentrates in an amount of at least about 0.0001 wt. %, and can be provided in a range of between about 0.0001 wt. % and about 20 wt. % based on the weight of the concentrate, and can be provided in a range of between about 0.001 wt. % and about 10 wt. % based on the weight of the concentrate. When the acid substituted polymer is used, it can be provided in the concentrate in a range of between about 0.0001 wt. % and about 20 wt. %, and can be provided in an amount of between about 0.002 wt. % and about 10 wt. %. When the phosphonocarboxylate and phosphanate components are used, they can be provided in the concentrate in an amount of between about 0.00005 wt. % and about 15 wt. %, and between about 0.0001 wt. % and about 8 wt. %. It should be understood that the acid substituted polymers and the phosphonocarboxylates and phosphanates can be used alone or in combination. The threshold inhibitor/crystal modifier can be provided in the use solution in an amount of at least about 1 ppm in the use solution.

Hydrotrope Component

A hydrotrope component can be used to help stabilize the surfactant in the corrosion inhibitor concentrate. It should be understood that the hydrotrope component is optional and can be omitted if it is not needed for stabilizing the surfactant component. In many cases, it is expected that the hydrotrope component will be present to help stabilize the surfactant component. Examples of the hydrotropes include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols, short chain ($C_8$ or less) alkyl polyglycoside, sodium, potassium and ammonium salts of the alkyl sarcosinates, salts of cumene sulfonates, amino propionates, diphenyl oxides, and disulfonates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution.

The hydrotrope component can be provided in the corrosion inhibitor concentrate in an amount sufficient to stabilize the surfactant component. When the hydrotrope component is used, it can be provided in an amount of between about 0.004 wt. % and about 30 wt. % based on the weight of the corrosion inhibitor concentrate, and can be provided in an amount of between about 0.02 wt. % and about 20 wt. % of the corrosion inhibitor concentrate.

Other Additives

Other additives may be included in the present metal cleaning compositions and solutions. Other additives may include, but are not limited to, additional surfactants, additional corrosion inhibitors, antimicrobials, fungicides, fragrances, dyes, antistatic agents, UV absorbers, reducing agents, buffering compounds, corrosion inhibitors, viscosity modifying (thickening or thinning) agents, and the like.

Additional Corrosion Inhibitors

Additional corrosion inhibitors which may be optionally added to the aqueous metal cleaning compositions of this invention include magnesium and/or zinc ions and $Ca(NO_2)_2$. Preferably, the metal ions are provided in water soluble form. Examples of useful water soluble forms of magnesium and zinc ions are the water soluble salts thereof including the chlorides, nitrates and sulfates of the respective metals. If any of the alkalinity providing agents are the alkali metal carbonates, bicarbonates or mixtures of such agents, magnesium oxide can be used to provide the Mg ion. The magnesium oxide is water soluble in such solutions and is a preferred source of Mg ions. In order to maintain the dispersibility of the magnesium and/or zinc corrosion inhibitors in aqueous solution, and in the presence of agents which would otherwise cause precipitation of the zinc or magnesium ions, e.g., carbonates, phosphates, etc., it might be advantageous to include a carboxylated polymer to the solution. The useful carboxylated polymers may be generically categorized as water-soluble carboxylic acid polymers such as polyacrylic and polymethacrylic acids or vinyl addition polymers, in addition to the acid-substituted polymers used in the present invention. Of the vinyl addition polymers contemplated, maleic anhydride copolymers as with vinyl acetate, styrene, ethylene, isobutylene, acrylic acid and vinyl ethers are examples. The polymers tend to be water-soluble or at least colloidally dispersible in water. The molecular weight of these polymers may vary over a broad range although it is preferred to use polymers having average molecular weights ranging between 1,000 up to 1,000,000. These polymers have a molecular weight of 100,000 or less and between 1,000 and 10,000.

The polymers or copolymers (either the acid-substituted polymers or other added polymers) may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

The metal cleaning compositions of the present invention can be used for removing contaminants including greases, cutting fluids, drawing fluids, machine oils, antirust oils such as cosmoline, carbonaceous soils, sebaceous soils, particulate matter, waxes, paraffins, used motor oil, fuels, etc. Metal surfaces that can be cleaned include iron-based metals such as iron, iron alloys, e.g., steel, tin, aluminum, copper, tungsten, titanium, molybdenum, etc., for example. The structure of the metal surface to be cleaned can vary widely. Thus, the metal surface can be as a metal part of complex configuration, sheeting, coils, rolls, bars, rods, plates, disks, etc. Such metal components can be derived from any source including for home use, for industrial use such as from the aerospace industry, electronics industry, etc., wherein the metal surfaces have to be cleaned.

The use solution of this invention has a pH selected for the effective removal of contaminants such as grease and oil from a metal surface. The pH can be at least about 10.0. The pH can be between about 10.0 and about 14.0, and can be between about 11.0 and about 13.5.

The use solution can have reduced silicate, and can be free of silicates. For example, the concentrate and/or the solution may have less than 0.2 wt. % silicates, less than 0.15 wt. % silicates, less than 0.1 wt. % silicates, less than 0.05 wt. % silicate and less than 0.1 wt. % silicate (down to and including 0 wt. % silicate) and perform in accordance with the teachings of this invention. In some embodiments, it is preferred to maintain the compositions of this invention substantially silicate-free due to the resultant high pH and difficulty in formulating a composition which will remain soluble in aqueous solution at a pH of 11.0 or less when silicates are present. Note, however that this reduced silicate preference does not limit the amount of silicone in the solution as silicone is not included in this definition of silicate.

The cleaners of the invention may exist in a use solution or concentrated solution that is in any form including liquid, gel, paste, solids, slurry, and foam. The cleaning solutions are suitable to treat any metal surface contaminated with a wide variety of contaminants. Exemplary contaminants include grease, clay, dirt, and oxide by-products. The present solutions may be used by contacting the contaminated metal parts with an effective amount of the aqueous solution. Preferred contact methods include immersion or some type of impingement in which the cleaning solution is circulated or continuously agitated against the metal part or is sprayed thereon. Alternatively, agitation can be provided as ultrasonic waves. The present invention is also suitable for clean-in-place operations that do not require disassembly of equipment.

The aqueous cleaning solutions of this invention may be used at any temperature, including an elevated temperature of from about 90–180° F. After contact with the cleaning solution, the solution is removed from the metal surface. The contact time of the aqueous cleaning solution with the metal substrates will vary depending upon the degree of contamination but broadly will range between a few seconds or about 1 minute to 30 minutes with 3 minutes to 15 minutes being more typical.

Tables 1 and 2 identify exemplary ranges of components for the alkaline concentrate and the corrosion inhibitor concentrate.

TABLE 1

ALKALINE CONCENTRATE

| Component | First Range | Second Range |
|---|---|---|
| Source of Alkalinity | 0.05–99 wt. % | 0.1–95 wt. % |
| First Chelating Agent Component | 0.005–55 wt. % | 0.01–50 wt. % |
| Threshold Inhibitor/Crystal Modifier Component | 0.0001–20 wt. % | 0.001–10 wt. % |

TABLE 2

CORROSION INHIBITOR CONCENTRATE

| Component | First Range | Second Range |
|---|---|---|
| Surfactant Component | 0.01–75 wt. % | 0.05–50 wt. % |
| Corrosion Inhibitor Component | 0.005–41.5 wt. % | 0.02–27 wt. % |
| Second Chelating Component | 0.003–23 wt. % | 0.01–15 wt. % |
| Hydrotrope Component | 0.004–30 wt. % | 0.02–20 wt. % |

The alkaline concentrate and the corrosion inhibitor concentrate can be diluted and combined to provide a cleaning composition having desired properties for cleaning while reducing corrosion and/or discoloration of alkaline sensitive metals. The alkaline concentrate can be incorporated into the use solution in an amount ranging from between about 0.001 wt. % to about 35 wt. %, and between about 0.005 wt. % and about 25 wt. %. In addition, the alkaline concentrate can be mixed with water to provide a use solution at a weight ratio of about 1 part alkaline concentrate to about 100,000 parts water to about 1 part alkaline concentrate to about 2 parts water. It should be understood that this weight ratio depends upon the activity of the alkaline concentrate and reflects the total amount of water used to form the use solution. Accordingly, the alkaline concentrate may first be mixed with a lower amount of water and then combined with a solution containing the corrosion inhibitor concentrate and water to provide the final use solution. The corrosion inhibitor concentrate can be provided in the use solution in an amount of between about 0.0005 wt. % and about 50 wt. %, and can be provided in an amount of between about 0.001 wt. % and about 35 wt. %. In addition, the weight ratio of the corrosion inhibitor concentrate to water in the use solution can be provided at between about 1 part corrosion inhibitor concentrate to about 200,000 parts water, and between about 1 part corrosion inhibitor concentrate to about 2 parts water. Again, it should be understood that this weight ratio is the weight ratio of the corrosion inhibitor concentrate (depending upon its activity level) to water in the use solution.

The following examples are presented to help illustrate the invention and should not be construed as limiting the invention.

EXAMPLE

The following example was carried out to illustrate the reduced corrosion of the cleaning composition according to the invention.

The following alkaline concentrate was provided in a solid form:

TABLE 3

| Wt. % | Concentrate 1 |
|---|---|
| 13.4 | Sodium Hydroxide 50% |
| 12 | Sodium Gluconate |
| 6 | ethylenediaminetetraacetic acid tetrasodium salt |
| 14.6 | N-hydroxyethylenediaminetriacetic acid trisodium salt 41% |
| 1.5 | 2-phosphonobutane-1,2,4-tricarboxylic acid 50% |
| 2.5 | Polyacrylate 929 |
| 50 | Sodium Hydroxide Bead |

The following concentrates were provided for comparison.

TABLE 4

| Wt. % | Concentrate A |
|---|---|
| 68.6 | Water, zeolite softened or Deionized |
| 10 | Calcium Chloride 90% |
| 4 | Lauryl Dimethylamine Oxide 30% |
| 3 | Alc. (C9–C11) 6 EO |
| 1.5 | Linear Alcohol 60–70% Ethoxylate |
| 0.15 | diethyl ammon. chlor. Glensurf 42 |
| 1.25 | disod. Octylimino dipropionate 50% |
| 5 | Citric Acid, 50% White |
| 6.5 | Sodium Xylene Sulfonate, 40% |

TABLE 5

| Wt. % | Concentrate B |
|---|---|
| 78.6 | Water, zeolite softened or Deionized |
| 4 | Lauryl Dimethylamine Oxide 30% |
| 3 | Alc. (C9–C11) 6 EO |
| 1.5 | Linear Alcohol 60–70% Ethoxylate |
| 0.15 | diethyl ammon. chlor. Glensurf 42 |
| 1.25 | disod. Octylimino dipropionate 50% |
| 5 | Citric Acid, 50% White |
| 6.5 | Sodium Xylene Sulfonate, 40% |

TABLE 6

| Wt. % | Concentrate C |
|---|---|
| 63.6 | Water, zeolite softened or Deionized |
| 10 | Calcium Chloride 90% |
| 4 | Lauryl Dimethylamine Oxide, 30% |
| 3 | Linear Alcohol Ethox. (C9–C11) 6 EO |
| 1.5 | Linear Alcohol 60–70% Ethoxylate |
| 0.15 | diethyl ammon. chlor. Glensurf 42 |
| 1.25 | disod. Octylimino dipropionate 50% |
| 10 | Citric Acid, 50% White |
| 6.5 | Sodium Xylene Sulfonate, 40% |

TABLE 7

| Wt. % | Concentrate D |
|---|---|
| 63.5 | Deionized water |
| 10 | Calcium Chloride 90% |
| 4 | Lauryl Dimethylamine Oxide, 30% |
| 3 | Linear Alcohol Ethox. (C9–C11) 6 EO |
| 1.5 | Linear alcohol 60–70% Ethoxylate |
| 0.15 | diethyl ammon. chlor. Glensurf 42 |
| 1.25 | disod. Octylimino dipropionate 50% |
| 10 | Citric Acid, 50% White |
| 6.5 | Sodium Xylene Sulfonate, 40% |
| 0.1 | Bayhibit AM (2-phosphono butane-1,2,4-tricarboxylic acid 150%) |

Corrosion testing was accomplished using the following equipment.

Equipment

Analytical balance capable of weighing to the 0.0001 place.

3–400ml beakers for each test condition

Aluminum Coupon size 2"×4"×1/16" Alloy 6061

Hot plate

Thermometer

Acetone

Deionized and soft water

Clean paper toweling

Stop watch

Engraver

Plastic disposable pipettes

Each aluminum coupon was numbered with an engraver. The aluminum coupons were cleaned with acetone and allowed to dry. The weight of each coupon was recorded to the fourth place. Test use solutions were prepared in water having the weight percentages of concentrates identified in Table 9. The test use solutions were heated to the identified temperature. Aluminum coupons were placed in the test solutions for 1 minute. The coupons were submerged. After 1 minute, the coupons were removed and rinsed with deionized water. The coupons were placed on a towel and allowed to dry in an upright position. The tested coupons were then weighed and the weight was taken to the fourth place. The weight loss was calculated. Three test were run for each experiment and the average weight loss was determined.

Test solutions were prepared by mixing concentrate 1 with water or concentrate 1 and one of concentrates A–D with water. Table 8 identifies exemplary test use solutions based upon the weight percent of the concentrate(s) and provides the pH of the test use solution.

TABLE 8

| Test Use Solution | Wt. % Concentrate | pH |
|---|---|---|
| 1 | 1.5 wt. % Concentrate 1 | 13.09 |
| 2 | 1.5 wt. % Concentrate 1<br>2.25 wt. % Concentrate A | 13.06 |
| 3 | 1.5 wt. % Concentrate 1<br>2.25 wt. % Concentrate B | 13.09 |
| 4 | 1.5 wt. % Concentrate 1<br>2.25 wt. % Concentrate C | 13.06 |
| 5 | 1.5 wt. % Concentrate 1<br>1.25 wt. % Concentrate C | 13.08 |
| 6 | 0.2 wt. % Concentrate 1 | 11.75 |
| 7 | 0.2 wt. % Concentrate 1<br>0.15 wt. % Concentrate A | 11.76 |
| 8 | 0.2 wt. % Concentrate 1<br>0.15 wt. % Concentrate B | 11.78 |
| 9 | 0.2 wt. % Concentrate 1<br>0.15 wt. % Concentrate C | 12.15 |

TABLE 9

| Use Solution | Before wt grams | After wt grams | Weight loss grams | Average weight loss |
|---|---|---|---|---|
| 1.5 wt. % Concentrate 1 at | 22.1047 | 22.0605 | 0.0442 | 0.0434 |
| 130° F. | 21.9157 | 21.8703 | 0.0454 | |
| | 22.1941 | 22.1536 | 0.0405 | |
| 1.5 wt. % Concentrate 1 | 22.0818 | 22.078 | 0.0038 | 0.0037 |
| 2.25 wt. % Concentrate C | 22.3506 | 22.347 | 0.0036 | |
| at 130° F. | 22.3144 | 22.3107 | 0.0037 | |
| 1.5 wt. % Concentrate 1 | 22.3141 | 22.3141 | 0.0000 | 0.0000 |
| 2.25 wt. % Concentrate D | 22.2484 | 22.2483 | 0.0001 | |
| at 130° F. | 22.3985 | 22.3985 | 0.0000 | |
| 1.5 wt. % Concentrate 1 | 22.343 | 22.3405 | 0.0025 | 0.0026 |
| 1.25 wt. % Concentrate A | 22.3486 | 22.3458 | 0.0028 | |
| at 130° F. | 21.4223 | 21.4199 | 0.0024 | |
| 1.5 wt. % Concentrate 1 | 22.3449 | 22.3417 | 0.0032 | 0.0032 |
| 1.0 wt. % Concentrate A | 22.0808 | 22.0773 | 0.0035 | |
| at 130° F. | 22.4014 | 22.3986 | 0.0028 | |
| 1.5 wt. % Concentrate A | 22.4068 | 22.4008 | 0.006 | 0.0068 |
| 0.75 wt. % Concentrate A | 22.4167 | 22.4086 | 0.0081 | |
| at 130° F. | 22.3942 | 22.3879 | 0.0063 | |
| 1.5 wt. % Concentrate A | 22.1278 | 22.0939 | 0.0339 | 0.0336 |
| 1.25 wt. % Concentrate B | 21.3682 | 21.336 | 0.0322 | |
| at 130° F. | 22.2674 | 22.2326 | 0.0348 | |
| 1.5 wt. % Concentrate 1 at | 22.4564 | 22.438 | 0.0184 | 0.0194 |
| 110° F. | 22.4293 | 22.4084 | 0.0209 | |
| | 22.0651 | 22.0463 | 0.0188 | |
| 1.5 wt. % Concentrate 1 | 22.3701 | 22.3535 | 0.0166 | 0.0171 |
| 1.25 wt. % Concentrate B | 22.3676 | 22.3511 | 0.0165 | |
| at 110° F. | 22.2662 | 22.248 | 0.0182 | |
| 1.5 wt. % Concentrate 1 | 22.3574 | 22.3574 | 0.0000 | 0.0001 |
| 1.25 wt. % Concentrate A | 22.2413 | 22.2413 | 0.0000 | |
| at 110° F. | 22.3431 | 22.3429 | 0.0002 | |
| 1.5 wt. % Concentrate 1 | 22.3272 | 22.3268 | 0.0004 | 0.0010 |
| 1.0 wt. % Concentrate A | 22.1616 | 22.1601 | 0.0015 | |
| at 110° F. | 22.3156 | 22.3145 | 0.0011 | |
| 1.5 wt. % Concentrate 1 | 22.2421 | 22.241 | 0.0011 | 0.0017 |
| 0.75 wt. % Concentrate A | 22.4628 | 22.461 | 0.0018 | |
| at 110° F. | 22.1665 | 22.1644 | 0.0021 | |
| 0.2 wt. % Concentrate 1 at | 22.2053 | 22.203 | 0.0023 | 0.0026 |
| 110° F. | 21.9932 | 21.9909 | 0.0023 | |
| | 22.2226 | 22.2195 | 0.0031 | |
| 0.2 wt. % Concentrate 1 | 22.0189 | 22.0185 | 0.0004 | 0.0005 |
| 0.15% Concentrate A at | 22.041 | 22.0401 | 0.0009 | |
| 110° F. | 22.4049 | 22.4048 | 0.0001 | |
| 0.2 wt. % Concentrate 1 | 22.2845 | 22.2825 | 0.002 | 0.0020 |
| 0.15 wt. % concentrate B | 22.3478 | 22.3458 | 0.002 | |
| at 110° F. | 22.3613 | 22.3592 | 0.0021 | |
| 0.2 wt. % Concentrate A | 22.3539 | 22.3539 | 0.0000 | 0.0000 |
| 0.15 wt. % Concentrate C | 22.0585 | 22.0585 | 0.0000 | |
| at 110° F. | 22.3314 | 22.3313 | 0.0001 | |
| 0.2 wt. % Concentrate 1 | 22.2765 | 22.2765 | 0.0000 | 0.0000 |
| 0.15 wt. % Concentrate D | 22.2052 | 22.2052 | 0.0000 | |
| at 110° F. | 22.0302 | 22.0302 | 0.0000 | |

TABLE 9-continued

| Use Solution | Before wt grams | After wt grams | Weight loss grams | Average weight loss |
|---|---|---|---|---|
| 0.2 wt. % Concentrate 1 at 130° F. | 22.3101 | 22.3045 | 0.0056 | 0.0065 |
| | 21.6282 | 21.6222 | 0.006 | |
| | 22.415 | 22.4072 | 0.0078 | |
| 0.2 wt. % Concentrate 1 | 22.2576 | 22.2574 | 0.0002 | 0.0007 |
| 0.15 wt. % Concentrate A | 22.2877 | 22.2863 | 0.0014 | |
| at 130° F. | 22.2256 | 22.2252 | 0.0004 | |
| 0.2 wt. % Concentrate 1 | 22.1228 | 22.122 | 0.0008 | 0.0012 |
| 0.15 wt. % Concentrate C | 21.3283 | 21.3266 | 0.0017 | |
| at 130° F. | 22.3511 | 22.35 | 0.0011 | |
| 0.2 wt. % Concentrate 1 | 22.0396 | 22.0389 | 0.0007 | 0.0007 |
| 0.15 wt. % Concentrate D | 22.2261 | 22.2255 | 0.0006 | |
| at 130° F. | 22.2569 | 22.256 | 0.0009 | |

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An alkaline sensitive metal cleaning composition comprising:

(a) an alkaline concentrate comprising:

(i) a source of alkalinity in an amount sufficient to provide a use solution having a pH of at least 10.0; and (ii) a first chelant component that exhibits soil removal properties when used at a pH of at least 10.0;

(b) a corrosion inhibitor concentrate comprising:

(i) a corrosion inhibitor component for reducing corrosion of alkaline sensitive metals when used in a use solution having a pH of at least 10.0;

(ii) a second chelant component for stabilizing the corrosion inhibitor in the second concentrate when the second concentrate is provided at a pH that is less than 8.0; and (iii) a surfactant component for providing cleaning properties when used at a pH of at least 10.0; and (c) a threshold inhibitor/crystal modifier component provided in at least one of the alkaline concentrate and the corrosion inhibitor concentrate to stabilize the corrosion inhibitor in a use solution at a pH of at least 10.0.

2. An alkaline sensitive metal cleaning composition according to claim 1, wherein the source of alkalinity comprises at least one of alkali metal hydroxides, alkali metal salts, silicates, phosphates, amines, and mixtures thereof.

3. An alkaline sensitive metal cleaning composition according to claim 1, wherein the source of alkalinity comprises at least one of sodium hydroxide, potassium hydroxide, and lithium hydroxide.

4. An alkaline sensitive metal cleaning composition according to claim 1, wherein the source of alkalinity is provided in the alkaline concentrate in an amount of between about 0.05 wt. % and about 99 wt. %.

5. An alkaline sensitive metal cleaning composition according to claim 1, wherein the first chelant component comprises at least one of sodium gluconate, pentasodium salt of diethylenetriamine pentaacetic acid, sodium glucoheptonate, ethylene diamine tetraacetic acid, salts of ethylene diamine tetraacetic acid, hydroxyethyl ethylene diamine triacetic acid, salts of hydroxyethyl ethylene diamine triacetic acid, nitrilotriacetic acid, salts of nitrilotriacetic acid, diethanolglycine sodium salt, ethanoldiglycine disodium salt, and mixtures thereof.

6. An alkaline sensitive metal cleaning composition according to claim 1, wherein the first chelant component is provided in the alkaline concentrate in an amount of between about 0.005 wt. % and about 55 wt. %.

7. An alkaline sensitive metal cleaning composition according to claim 1, wherein the corrosion inhibitor component comprises a source of calcium ion.

8. An alkaline sensitive metal cleaning composition according to claim 1, wherein the corrosion inhibitor component comprises at least one of calcium salts, calcium oxides, and mixtures thereof.

9. An alkaline sensitive metal cleaning composition according to claim 1, wherein the corrosion inhibitor component comprises at least one of calcium acetate, calcium chloride, calcium gluconate, calcium phosphate, calcium borate, calcium carbonate, calcium citrate, calcium lactate, calcium sulfate, calcium tartrate, and mixtures thereof.

10. An alkaline sensitive metal cleaning composition according to claim 1, wherein the corrosion inhibitor component is provided in the corrosion inhibitor concentrate in an amount of between about 0.005 wt. % and about 41.5 wt. %.

11. An alkaline sensitive metal cleaning composition according to claim 1, wherein the second chelant component comprises at least one of hydroxymonocarboxylic acid compounds, hydroxydicarboxylic acid compounds, amine containing carboxylic acids, and mixtures thereof.

12. An alkaline sensitive metal cleaning composition according to claim 1, wherein the second chelant component is provided in the corrosion inhibitor concentrate in an amount of between about 0.003 wt. % and about 23 wt. %.

13. An alkaline sensitive metal cleaning composition according to claim 1, wherein the surfactant component comprises at least one of anionic surfactants, nonionic surfactants, cationic surfactants, amphoteric surfactants, zwitterionic surfactants, and mixtures thereof.

14. An alkaline sensitive metal cleaning composition according to claim 1, wherein the surfactant component is provided in the corrosion inhibitor concentrate in an amount of between about 0.01 wt. % and about 75 wt. %.

15. An alkaline sensitive metal cleaning composition according to claim 1, wherein the threshold inhibitor/crystal modifier component comprises at least one of phosphonocarboxylic acids, phosphonates, acid substituted polymers, and mixtures thereof.

16. An alkaline sensitive metal cleaning composition according to claim 1, wherein the threshold inhibitor/crystal modifier component is provided as part of the alkaline concentrate in an amount of between about 0.0001 wt. % and about 20 wt. %.

17. An alkaline sensitive metal cleaning composition according to claim 1, wherein the threshold inhibitor/crystal modifier component is provided as part of the corrosion inhibitor concentrate in an amount of between about 0.0001 wt. % and about 20 wt. %.

18. An alkaline sensitive metal cleaning composition according to claim 1, wherein the composition is provided as a use solution containing between about 0.001 wt. % to about 35 wt. % of the alkaline concentrate and between about 0.0005 wt. % and about 50 wt. % of the corrosion inhibitor concentrate.

19. A method for cleaning an alkaline sensitive metal surface, the method comprising steps of:

(a) diluting and mixing an alkaline concentrate and a corrosion inhibitor concentrate with water to provide a use solution, wherein:
  (i) the alkaline concentrate comprising:
    (A) a source of alkalinity in an amount sufficient to provide a use solution having a pH of at least 10.0; and
    (B) a first chelant component that exhibits soil removal properties when used at a pH of at least 10.0;
  (ii) the corrosion inhibitor concentrate comprising:
    (A) a corrosion inhibitor component for reducing corrosion of alkaline sensitive metals when used in a use solution having a pH of at least 10.0;
    (B) a second chelant component for stabilizing the corrosion inhibitor in the corrosion inhibitor concentrate when the corrosion inhibitor concentrate is provided at a pH that is less than 8.0; and
    (C) a surfactant component for providing cleaning properties when used at a pH of at least 10.0; and
  (iii) a threshold inhibitor/crystal modifier component provided in at least on of the alkaline concentrate and the corrosion inhibitor concentrate to stabilize the corrosion inhibitor in a use solution at a pH of at least 10.0; and
(b) applying the use solution to an alkaline sensitive metal.

20. A method according to claim 19, wherein the alkaline sensitive metal comprises at least one of aluminum, nickel, tin, zinc, copper, brass, bronze, and mixtures thereof.

21. A method according to claim 19, wherein the alkaline sensitive metal surface comprises at least one of aluminum and aluminum alloys.

22. A method according to claim 19, wherein the step of applying the use solution to an alkaline sensitive metal comprises applying the use solution to the wheels of a vehicle in a vehicle washing facility.

23. A method according to claim 19, wherein the step of applying the use solution to an alkaline sensitive metal comprises applying the use solution to aluminum or aluminum alloy provided on a truck.

24. A method according to claim 19, wherein the source of alkalinity comprises at least one of alkali metal hydroxides, alkali metal salts, silicates, phosphates, amines, and mixtures thereof.

25. A method according to claim 19, wherein the source of alkalinity comprises at least one of sodium hydroxide, potassium hydroxide, and lithium hydroxide.

26. A method according to claim 19, wherein the source of alkalinity is provided in the alkaline concentrate in an amount of between about 0.05 wt. % and about 99 wt. %.

27. A method according to claim 19, wherein the first chelant component comprises at least one of sodium gluconate, pentasodium salt of diethylenetriamine pentaacetic acid, sodium glucoheptonate, ethylene diamine tetraacetic acid, salts of ethylene diamine tetraacetic acid, hydroxyethyl ethylene diamine triacetic acid, salts of hydroxyethyl ethylene diamine triacetic acid, nitrilotriacetic acid, salts of nitrilotriacetic acid, diethanolglycine sodium salt, ethanoldiglycine disodium salt, and mixtures thereof.

28. A method according to claim 19, wherein the first chelant component is provided in the alkaline concentrate in an amount of between about 0.005 wt. % and about 55 wt. %.

29. A method according to claim 19, wherein the corrosion inhibitor component comprises a source of calcium ion.

30. A method according to claim 19, wherein the corrosion inhibitor component comprises at least one of calcium salts, calcium oxides, and mixtures thereof.

31. A method according to claim 19, wherein the corrosion inhibitor component comprises at least one of calcium acetate, calcium chloride, calcium gluconate, calcium phosphate, calcium borate, calcium carbonate, calcium citrate, calcium lactate, calcium sulfate, calcium tartrate, and mixtures thereof.

32. A method according to claim 19, wherein the corrosion inhibitor component is provided in the corrosion inhibitor concentrate in an amount of between about 0.005 wt. % and about 41.5 wt. %.

33. A method according to claim 19, wherein the second chelant component comprises at least one of hydroxymonocarboxylic acid compounds, hydroxydicarboxylic acid compounds, amine containing carboxylic acids, and mixtures thereof.

34. A method according to claim 19, wherein the second chelant component is provided in the corrosion inhibitor concentrate in an amount of between about 0.003 wt. % and about 23 wt. %.

35. A method according to claim 19, wherein the surfactant component comprises at least one of anionic surfactants, nonionic surfactants, cationic surfactants, amphoteric surfactants, zwitterionic surfactants, and mixtures thereof.

36. A method according to claim 19, wherein the surfactant component is provided in the corrosion inhibitor concentrate in an amount of between about 0.01 wt. % and about 75 wt. %.

37. A method according to claim 19, wherein the threshold inhibitor/crystal modifier component comprises at least one of phosphonocarboxylic acids, phosphonates, acid substituted polymers, and mixtures thereof.

38. A method according to claim 19, wherein the threshold inhibitor/crystal modifier component is provided as part of the alkaline concentrate in an amount of between about 0.0001 wt. % and about 20 wt. %.

39. A method according to claim 19, wherein the threshold inhibitor/crystal modifier component is provided as part of the corrosion inhibitor concentrate in an amount of between about 0.0001 wt. % and about 20 wt. %.

40. A method according to claim 19, wherein the step of dilulting comprises providing the use solution with between about 0.001 wt. % to about 35 wt. % of the alkaline concentrate and between about 0.0005 wt. % and about 50 wt. % of the corrosion inhibitor concentrate.

41. A washing facility comprising:
(a) a first component tank comprising an alkaline concentrate comprising:
  (i) a source of alkalinity in an amount sufficient to provide a use solution having a pH of at least 10.0; and
  (ii) a first chelant component that exhibits soil removal properties when used at a pH of at least 10.0;
(b) a second component tank comprising a corrosion inhibitor concentrate comprising:
  (i) a corrosion inhibitor component for reducing corrosion of alkaline sensitive metals when used in a use solution having a pH of at least 10.0;
  (ii) a second chelant component for stabilizing the corrosion inhibitor in the corrosion inhibitor concentrate when the corrosion inhibitor concentrate is provided at a pH that is less than 8.0; and
  (iii) a surfactant component for cleaning properties when used at a pH of at least 10.0;
(c) a mixing vessel for forming a use solution from water, the alkaline concentrate, and the corrosion inhibitor concentrate;
(d) a water feed for conveying water to the mixing vessel; and
(e) a use solution line for conveying the use solution from the mixing vessel to a use solution applicator.

* * * * *